US005746316A

United States Patent [19]

La Barre

[11] Patent Number: 5,746,316

[45] Date of Patent: May 5, 1998

[54] TRAY CONNECTING MEMBERS FOR A DRILL BIT CASE

[75] Inventor: Charles La Barre, Woodbury, Minn.

[73] Assignee: Huot Manufacturing Company, St. Paul, Minn.

[21] Appl. No.: 788,192

[22] Filed: Jan. 24, 1997

Related U.S. Application Data

[63] Continuation of Ser. No. 496,308, Jun. 29, 1995, abandoned.

[51] Int. Cl.[6] ..... B65D 85/20

[52] U.S. Cl. ..... 206/379; 206/443

[58] Field of Search ..... 206/349, 372, 206/373, 376, 377, 378, 379, 1.5, 443

[56] References Cited

U.S. PATENT DOCUMENTS

| | | | |
|---|---|---|---|
| 3,074,539 | 1/1963 | Rogovin | 206/379 |
| 4,006,821 | 2/1977 | Sautter | 206/379 |

*Primary Examiner*—Jacob K. Ackun

*Attorney, Agent, or Firm*—Patterson & Keough, P.A.

[57] ABSTRACT

A case for containing objects such as drill bits respectively disposed in a plurality of trays which are pivotally mounted within the case to be carried therein in substantially superposed condition, the case having a hinged cover thereover, and said trays and said cover being respectively interconnected by connecting members having end portions particularly configured to be disposed to be releasably self secured in accommodating apertures.

3 Claims, 2 Drawing Sheets

FIG. 2
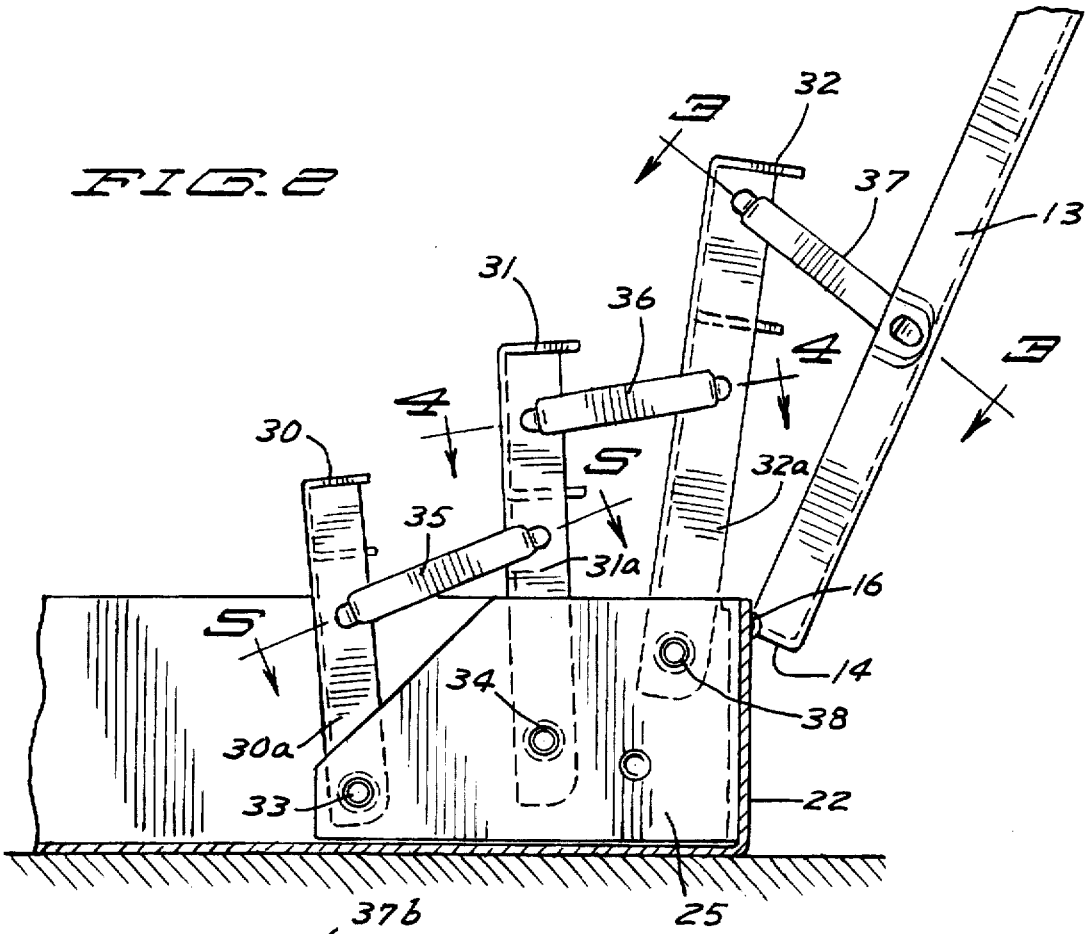
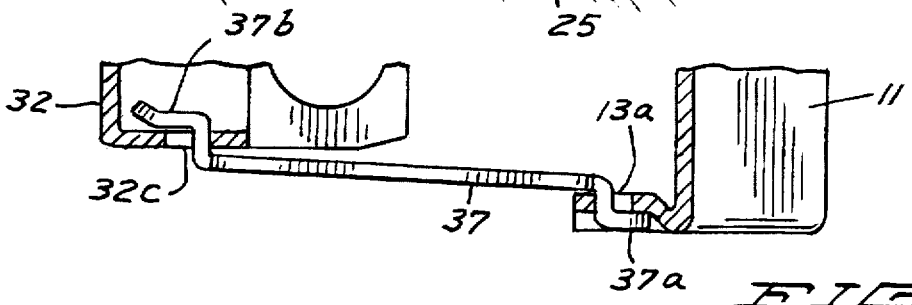
FIG. 3
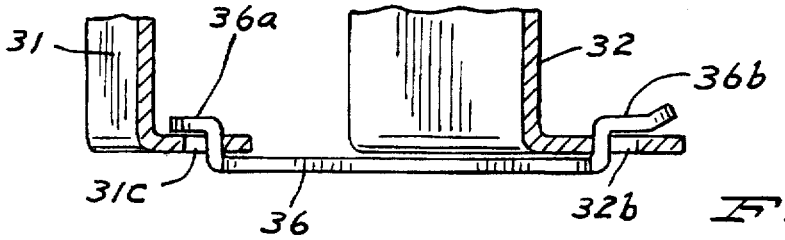
FIG. 4
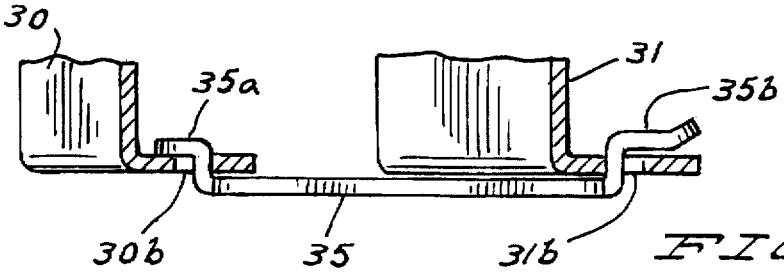
FIG. 5

TRAY CONNECTING MEMBERS FOR A DRILL BIT CASE

This application is a continuation of application Ser. No. 08/496,308 filed Jun. 29, 1995 and allowed May 29, 1996 and now abandoned.

BACKGROUND OF THE INVENTION

1. Field of Invention

This invention relates to a case for drill bits wherein releasable self securing members connect bit holding trays therein in connection with the cover thereof for raising the trays to make the bits held therein accessible.

2. Description of the Previous Art

Various types of containers have been developed to house drill bits to make them readily available for use. In general the containers have therein connected pivotal trays which are raised to a vertical position by an opening or raising of the cover of the container.

The trays and cover are connected by strap members of which end portions are secured to the respective trays and cover by pins or rivets or equivalents and they may be secured as by welding.

SUMMARY OF THE INVENTION

It is a principal object and purpose of this invention to simplify and make more expedient the connection of the trays of a drill case and their connection with the cover thereof.

It is another object herein to provide connecting members to connect the trays and cover by particularly forming the connector end portions to make them releasably self securing upon being disposed into accommodating apertures in one side of trays and cover.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a perspective view showing the drill case of the invention in open position;

FIG. 2 is a view partially in horizontal section taken on line 2—2 of FIG. 1 and partially in side elevation;

FIG. 3 is a broken view partially in horizontal section taken on line 3—3 of FIG. 2 as shown;

FIG. 4 is a view similar to that of FIG. 3 partially in horizontal section taken on line 4—4 of FIG. 2;

FIG. 5 is a view similar to that of FIG. 4 in vertical section taken on line 5—5 of FIG. 2.

DESCRIPTION OF A PREFERRED EMBODIMENT

Figures 6, 7:
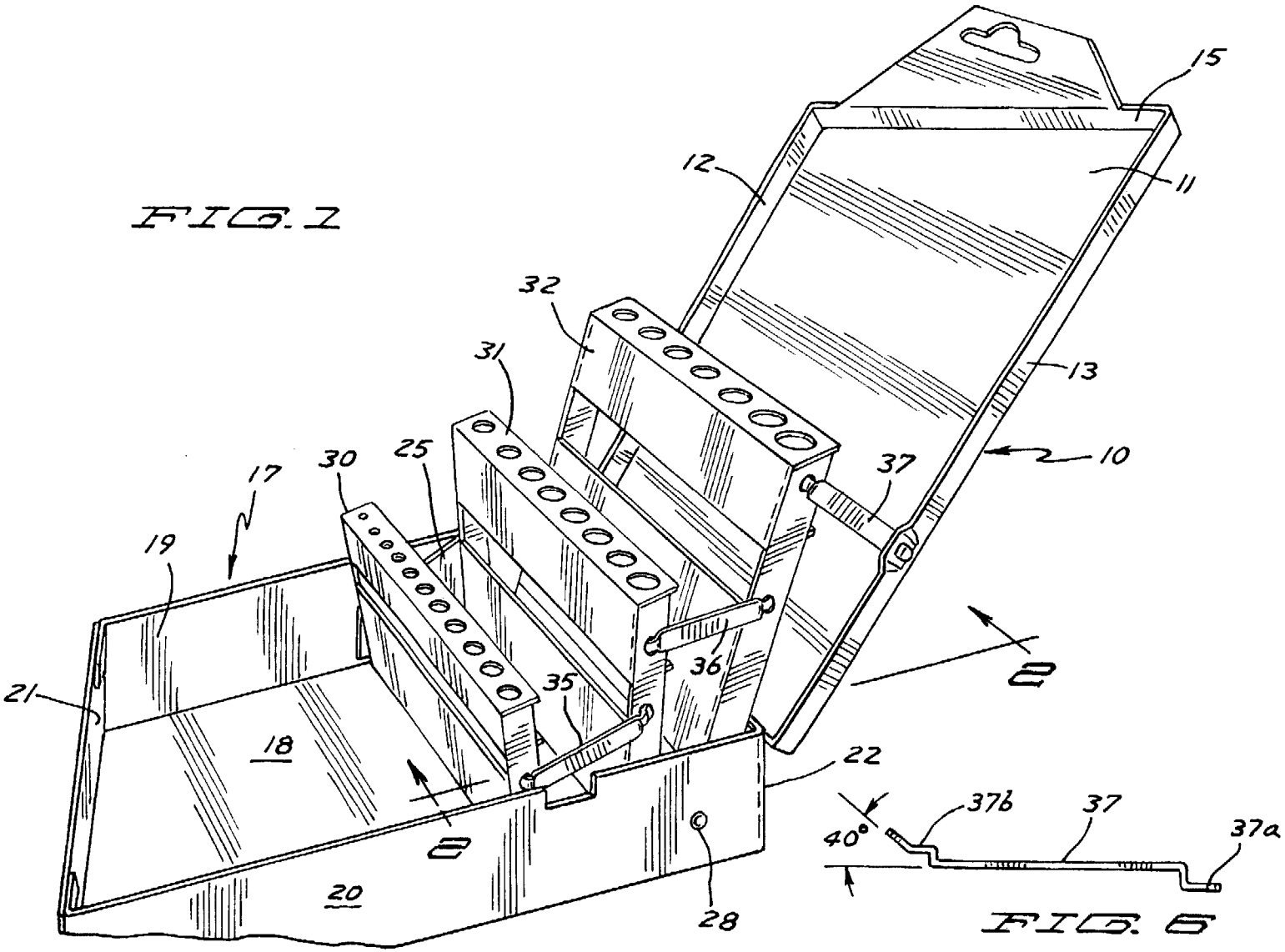
FIG. 6 is a side elevational view of a connecting member showing the angle of elevation of the locking insertion end thereof.

Referring to the drawings and more particularly to FIG. 1, the invention comprising a drill case as here shown in perspective is substantially trapezoidal in form and is indicated generally by the reference numeral 10. Said device has a cover 11 having narrow side walls 12 and 13 and end walls 14 and 15. Said cover has its end wall 14 conventionally hinged at 16 to the adjacent end wall 22 of the base or base chamber 17 of said case.

Said base chamber comprises a bottom wall 18, side walls 19 and 20 and end walls 21 and 22.

Disposed into said base chamber abutting the end wall 22 thereof is U-shaped insert member 25. Said insert member is secured in position by receiving therein indents at each side of said base chamber as at 28 which are disposed into corresponding apertures in the adjacent sides of said insert member but not here shown. Said indents disposed thus into their corresponding apertures in said U-insert member hold said insert member in position.

Pivotally mounted onto said insert in a conventional manner as shown in FIG. 2 are drill bit trays 30, 31 and 32 and the same are positioned to be pivotally secured as at 33, 34 and 38 with corresponding pivotal connections at the opposed remote sides of said U-insert and of said trays. Said trays are positioned such that when tilted forwardly to be horizontally disposed, the upper trays overlie the respective lower trays in superposed position.

Drill bits are not here shown loaded into the trays, however said trays are conventional to receive drill bits for storage.

The particular novelty herein is present in the simple and expedient manner of connecting the trays and connecting the cover with the trays and as will be shown the novelty is present in the particular configuration of the end portions of the connecting members which makes possible the expedient connection of the trays and the connecting members are at one side only of the trays and cover. The connecting members are here shown to be elongated and strap like in form and of small transverse dimension.

Referring again to FIG. 2, the trays and cover are shown in an elevational side view with the sides 30*a*, 31*a* and 32*a* of said respective trays being shown as well as the side 13 of the cover 11.

Said sides or side walls respectively have apertures 30*b*, 31*b* and 31*c*, 32*b* and 32*c* and said cover side 13 has an aperture 13*a*.

The connecting members for the trays are 35 and 36 and the connecting member for the top or uppermost tray and the cover is 37. The members are somewhat flexible.

The connecting members 35 and 36 are identical. With reference to FIG. 5, the member 35 has a stepped end portion having an upward right angled portion which extends into a right angled horizontal outward extending portion and this will be referred to as an initial insert portion 35*a*. At the other end of said connecting member, there is a right angled upwardly angled portion which has somewhat less than a right angled outwardly extending portion having an upwardly angled tip portion and is referred to as the locking insertion end portion 35*b* of said member.

The member 36 has correspondingly formed portions 36*a* and 36*b*.

The connecting member 37 connects the trays 32 and the cover 11 having an initial insertion end portion 37*a* which has a reverse configuration of that of the corresponding end portions 35*a* and 36*a*. The end portions 35*a* and 36*a* are inserted respectively into and through the apertures 30*b* and 31*c* of the trays 30 and 31 from the outer sides of their respective side walls to within and through the same.

The corresponding end portions 37*a* of the connecting member 37 is inserted into and through the aperture 13*a* from within the inner side of the side wall 13 to be disposed outwardly thereof. This is the reverse of the positioning of the end portions 35*a* and 36*a*.

Referring again to member 35, with the end portion 35*a* inserted into and through the aperture 30*b*, the other end 35*b* thereof is taken in hand and bearing somewhat against its being held in the aperture 30*b*, the member 35 is sufficiently flexible to be flexed or curved outwardly to the extent of having the outer curved end or tip portion 35*b* thereof brought into alignment with and inserted into the aperture 31*b* and upon being released, it springs to a locked position connecting the trays 30 and 31. In like manner the trays 31 and 32 are connected to the member 36.

Shown in FIG. 6 with the connecting member 37 for illustration, is the angle of the end flexed for insertion for locking engagement.

Next, the member 37, which is already connected to the cover 11 as described, is taken in hand and flexed in the manner of the member 35 to have its curved tip end portion 37*b* inserted into and through the aperture 32*c* to connect the cover 11 with the tray 32. It is noted that the connecting members are only at one side of the trays and cover.

The action of the cover upon being lifted or lowered operates the trays raising them to an accessible position or lowering them for storage of the bits in superposed position of said trays.

The trays and the cover are securely releasably locked in their connected relationship.

It will of course be understood that various changes may be made in the form, details, arrangement and proportions of the structure described without departing from the scope of the invention which, generally stated, consists in a product capable of carrying out the objects above set forth in the parts and combination of parts as disclosed and defined in the appended claims.

What is claimed is:

1. A case for containing drill bits comprising a trapezoidal housing having parallel side walls, a front end and a rear end wall and a cover pivoted to said rear end wall, a plurality of bit holding trays including a first and a last tray in parallel arrangement with each other and with said cover, means pivotally securing said trays between said side walls of said housing, said trays and said cover have side walls, a first aperture in the side walls of said trays and said cover at one side of said housing, a second aperture in said side walls of said trays at said one side of said housing except for said first tray, elongated connecting members connecting each of said trays, and said cover with said rear tray, said connecting members each having a stepped end portion for initial insertion into said first aperture of each of said side walls of said trays and said cover, each of said connecting members having at its other end portion a locking substantailly right angled portion having an upwardly angled tip portion for insertion into said second aperture, and said connecting members being flexed for insertion of their respective end portions into said respective first and second apertures and upon being released said members elongate to extend into locking positions into said respective apertures, and movement of said cover raises and lowers said trays.

2. A case for containing drill bits comprising a housing having parallel side walls, front and rear end walls and a cover hinged to said rear end wall, a plurality of trays including a front and rear tray, means pivotally securing said trays between said side walls of said housing and parallel to said cover, said trays and said cover having side walls, a first aperture in each of said side walls of said trays and cover at one side thereof, a second aperture in said side walls of said one side of said trays except for said front tray, elongated flexible connecting members connecting said trays, and a connecting member connecting said rear tray and said cover, said connecting members each having an angled end portion for insertion into each of said first apertures, said connecting members having angled other end portion having upwardly extending tip portions adapted for locking engagement in said second apertures of said trays except for said first tray, said connecting members being flexed for insertion of their respective end portions into said respective first and second mentioned apertures and then released upon insertion for locking engagement in said respective apertures.

3. The structure of claim 2, wherein said connecting member connecting said rear tray and said cover having end portions positioned reversely of that of said connecting members connecting said trays.

* * * * *